US007455069B2

(12) United States Patent
Sumner

(10) Patent No.: US 7,455,069 B2
(45) Date of Patent: Nov. 25, 2008

(54) TENT WITH PASS-THROUGH PORT

(75) Inventor: Bobby G. Sumner, Atlanta, GA (US)

(73) Assignee: Wingroup North America, Inc., Norcross, GA (US)

( * ) Notice: Subject to any disclaimer, the term of this patent is extended or adjusted under 35 U.S.C. 154(b) by 0 days.

(21) Appl. No.: 10/920,604

(22) Filed: Aug. 17, 2004

(65) Prior Publication Data

US 2005/0045220 A1 Mar. 3, 2005

Related U.S. Application Data

(60) Provisional application No. 60/498,162, filed on Aug. 27, 2003.

(51) Int. Cl.
*E04H 15/58* (2006.01)
*E04H 15/14* (2006.01)

(52) U.S. Cl. ..... 135/117; 135/93; 135/137

(58) Field of Classification Search ..... 135/91–93, 135/116, 137, 120.1, 124, 96, 117; 52/2.17, 52/2.22; 354/308–309
See application file for complete search history.

(56) References Cited

U.S. PATENT DOCUMENTS 2,230,454 A * 2/1941 Friesner et al. ..... 135/117
3,250,024 A * 5/1966 Douthitt et al. ..... 434/286
4,077,417 A * 3/1978 Beavers ..... 135/121
4,485,489 A * 12/1984 Pilie et al. ..... 2/457
4,731,627 A * 3/1988 Chisholm ..... 396/592
5,031,516 A * 7/1991 Jacobson ..... 454/195
5,078,096 A * 1/1992 Bishop et al. ..... 119/497
5,216,948 A * 6/1993 Sheppard et al. ..... 99/483
5,592,960 A * 1/1997 Williams ..... 135/87
5,762,085 A * 6/1998 Punch ..... 135/93
5,808,865 A * 9/1998 Alves ..... 361/685
5,918,615 A * 7/1999 Stuck, Sr. ..... 135/135
6,745,788 B1 * 6/2004 Brown ..... 135/117
6,772,779 B1 * 8/2004 Pearcy ..... 135/96
6,772,883 B2 * 8/2004 Lindamood ..... 206/320
7,031,147 B2 * 4/2006 Zheng ..... 135/91
7,047,992 B1 * 5/2006 Fluellen ..... 135/98
7,131,236 B2 * 11/2006 Sample et al. ..... 52/79.5

* cited by examiner

*Primary Examiner*—Winnie Yip
(74) *Attorney, Agent, or Firm*—Gardner Groff Greenwald & Villanueva, PC

(57) ABSTRACT

A tent having a pass-through port through a wall panel for allowing an item to be passed in and out of the tent without opening the tent door. The pass-through port can be snugly tightened about a cord or hose extending therethrough to prevent insects from entering the tent.

19 Claims, 4 Drawing Sheets

TENT WITH PASS-THROUGH PORT

CROSS-REFERENCE TO RELATED APPLICATION

This application claims the benefit of U.S. Provisional Patent Application Ser. No. 60/498,162, filed Aug. 27, 2003, which application is incorporated herein by reference in its entirety for all purposes.

TECHNICAL FIELD

The present invention relates generally to tents for camping and shelter, and more particularly to a tent having an adjustable port for ventilation and/or for passing items through a wall panel between the interior and exterior of the tent.

BACKGROUND OF THE INVENTION

Fabric tents are used by campers, hikers, hunters and others to provide portable shelter. The tents commonly include a collapsible rigid frame of aluminum or fiberglass poles, and a flexible fabric shell of nylon, canvas or the like, typically including one or more wall panels, a roof and a floor. Access to and from the interior of the tent is typically through a door opening through a wall panel, which can be selectively opened and closed, as by a zipper, snaps, tie cords, or other closure means.

One or more panels of open mesh material are sometimes included in the fabric shell to form windows and/or a screen door, allowing visibility through the tent walls, but preventing insects from entering the tent's interior. A rainfly or flap is often provided to cover the mesh panels, if desired, for privacy or to prevent rain or dust from entering the tent's interior.

In many instances, it becomes necessary for tent users to pass an item through the wall of a tent. For example, a person inside the tent may wish to pass a tool or other item to or from a person outside the tent. Or the tent user may wish to have an extension cord pass through the wall of the tent to provide power for a light, a fan, a radio, or other electrical appliance; and/or to have a hose extend through the wall of the tent to provide water drainage. Typically, the only portal through which to pass an item is the tent's door. But repeatedly opening and closing the door can be cumbersome and annoying, and can permit mosquitoes and other insects to enter into the tent's interior. Also, extending an extension cord or hose through the door creates an inconvenience and tripping hazard to persons entering and exiting the tent.

Thus it can be seen that needs exist for improvements to tents to provide a mechanism for passing an item through a tent wall without the need for opening and closing the tent door. It is to the provision of an improved tent meeting these and other needs that the present invention is primarily directed.

SUMMARY OF THE INVENTION

In example forms, the present invention is an improved tent having one or more pass-through ports through a wall portion of the tent. The pass-through port is preferably provided with a closure such as a zipper, hook-and-loop fasteners, and/or an adjustable cord drawstring, to permit items to be conveniently passed by hand to and from the interior of the tent, without the need for opening and closing the tent door. The closure preferably can be tightened snugly around a cord, hose, or other item passing through the port to close any opening or gap that could otherwise provide opportunity for insects to enter the tent's interior, and to secure the item in place.

In example embodiments, the pass-through port includes a mesh panel to improve air circulation to and from the tent's interior. Two or more ports are optionally located on opposite walls of the tent and/or adjacent a corner of the tent to provide crossflow ventilation. An adjustable (open or closed) flap or cover may be provided to prevent rain from passing through the port. Each port is preferably located in a side or rear wall of the tent, where it will not interfere with ingress and egress through the tent's door; and the port is preferably at or near floor level, to prevent an extension cord or other item extending through the port from significantly stressing or distorting the fabric of the tent wall.

In one aspect, the present invention is a tent having at least one wall panel, a door through the wall panel, and at least one pass-through port through the wall panel. The pass-through port is preferably selectively openable to permit passage of an item therethrough.

In another aspect, the invention is a pass-through port for a tent, the pass-through port having a port cover and a closure allowing the pass-through port to be selectively opened and closed by a user.

In still another aspect, the invention is an improvement to a tent of the type having at least one wall panel, a floor, a roof and a door for ingress and egress to and from an interior of the tent, the improvement being the inclusion of at least one pass-through port through the wall panel proximal the floor. Each pass-through port preferably takes the form of a curved opening having a mesh port cover selectively openable and closable by a two-way zipper, and has a cover flap covering an exterior and/or interior face thereof.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
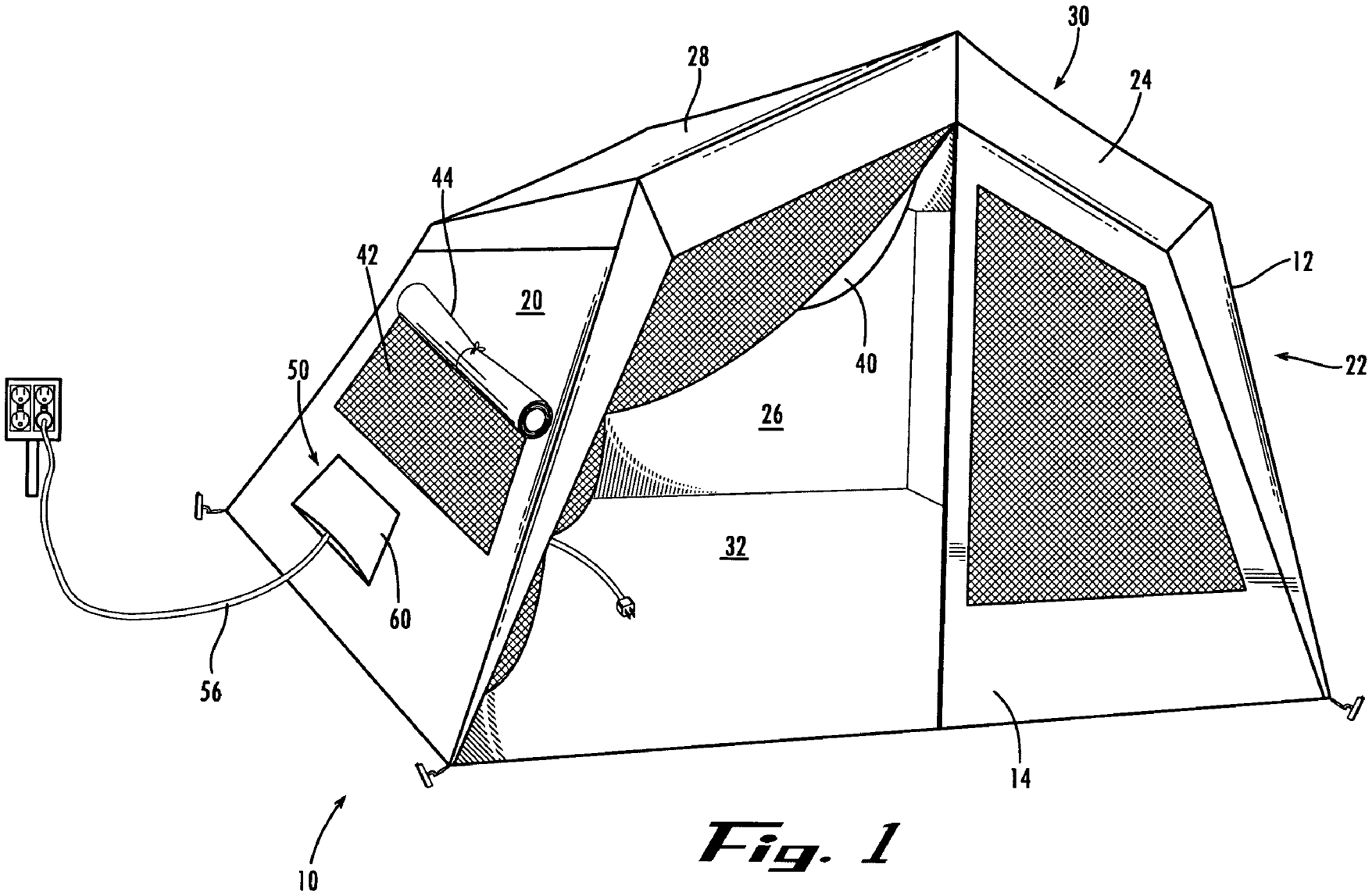
FIG. 1 is a perspective view of a tent having a pass-through port according to an example embodiment of the invention.

With reference now to the drawing figures, FIG. 1 depicts a tent 10 according to an example embodiment of the present invention which generally comprises a collapsible rigid frame 12 of aluminum or fiberglass poles, and a flexible fabric shell 14 of nylon, canvas or the like. The tent includes left and right side wall panels 20, 22, front and rear wall panels 24, 26, roof panels 28, 30 and a floor 32. Access to and from the interior of the tent is provided through a zippered door 40. As seen in FIG. 1, the wall panels can include one or more windows 42 formed of see-through mesh panels for visibility and ventilation. Privacy flaps or rainflies 44 can be closed to cover the windows.

Figure 2:
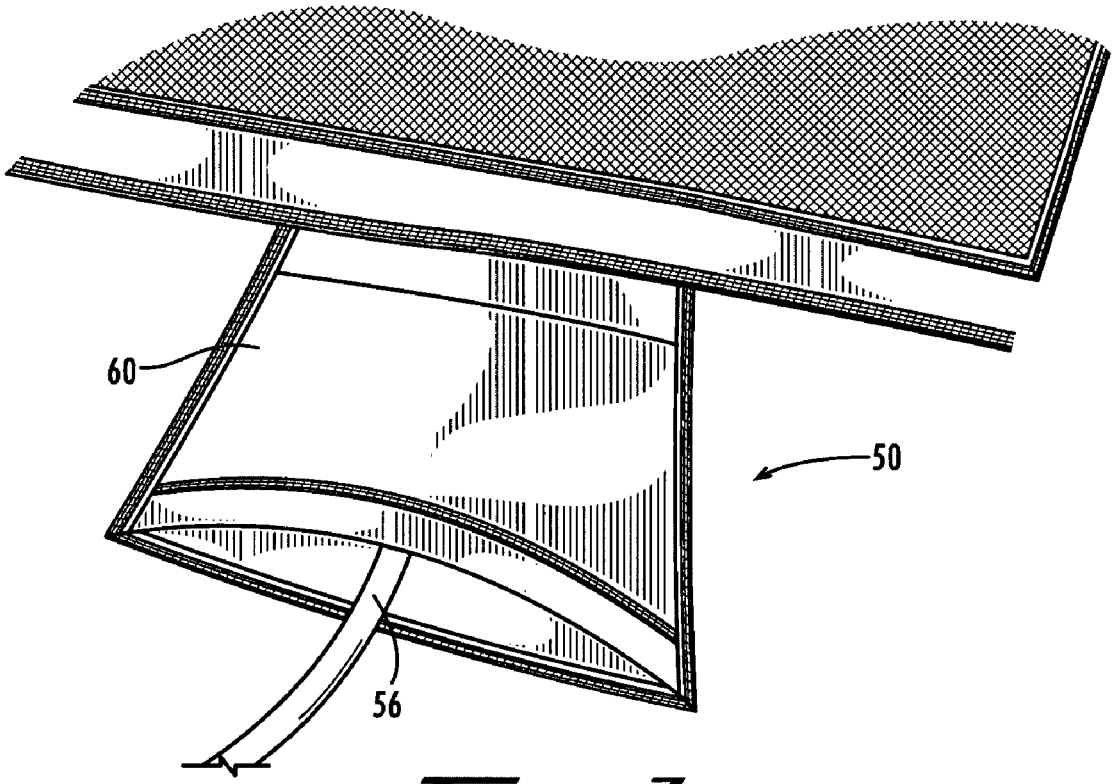
FIG. 2 is a detailed exterior view of a pass-through port according to an example embodiment of the invention.

One or more pass-through port(s) 50 are provided through at least one of the fabric panels of the tent. The pass-through port(s) is/are preferably provided through one or both of the side wall panels; but in alternate embodiments may be provided through the front or rear wall panels, the floor panel, and/or a roof panel. Each pass-through port 50 preferably comprises an opening or slit through the fabric of the wall panel. As depicted in FIG. 2, the pass-through port 50 is preferably configured having a size, location and shape to permit items to be conveniently passed by hand to and from the interior of the tent without the need for opening and closing the tent door, to improve air circulation and ventilation, and/or to permit a cord or hose 56 to be passed through the wall panel and secured in place, without hindering ingress and egress through the door 40 and without interfering with the line of sight through windows 42 or adversely affecting ordinary use of the tent's interior space. For example, the pass-through port(s) 50 is/are preferably located in a wall panel of the tent beneath the level of the windows 42. The pass-through port(s) 50 is/are preferably located a small distance above the level of the floor 32, to prevent any standing water on the ground outside the tent from entering through the port, but sufficiently close to the floor level to allow a hose or cord to extend through the port without unduly distorting the fabric of the wall panel. In example embodiments, the pass-through port(s) 50 is/are preferably located between about 2" to about 18" above the floor level, and more preferably about 4" to about 12" above floor level.

Figure 3:
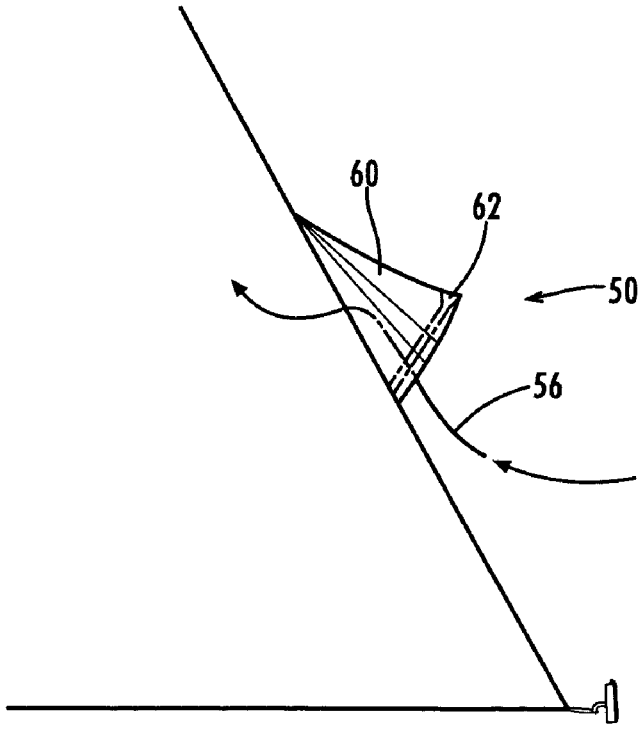
FIG. 3 is a side view of a pass-through port according to an example embodiment of the invention, having an exterior cover portion thereof in a raised or open configuration.

A cover flap 60, as seen best in FIG. 3, is preferably provided, covering the exterior of the pass-through port 50 to prevent rain, dust and the like from entering the tent through the pass-through port. The cover flap 60 is preferably pleated to provide sufficient fabric to be fully opened and not block the pass-through port 50, and to be closed to completely cover the pass-through port. The cover flap 60 also preferably includes means 62, such as one or more stiff plastic or wire arms or braces, and/or sections of hook-and-loop fasteners, for selectively holding the flap in an open position as shown in FIG. 3 to allow ventilation, or in a closed position to prevent entry of rain or dust.

Figure 4A:
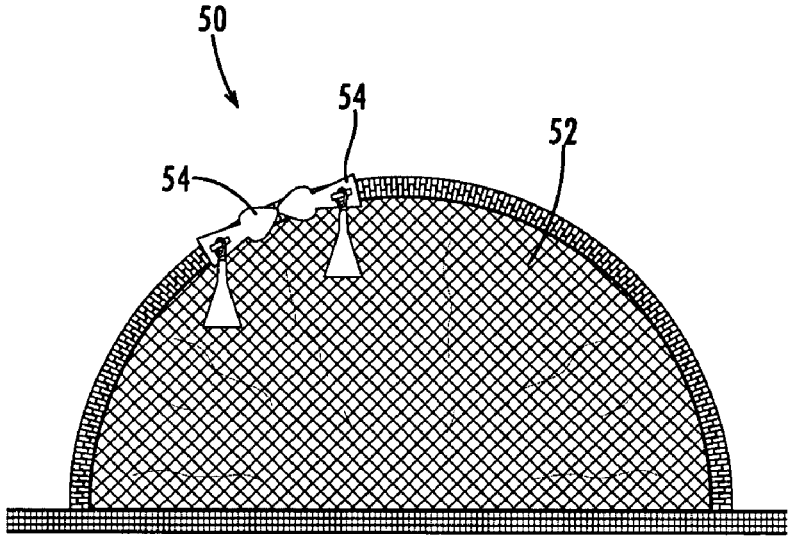
FIGS. 4*a* and 4*b* are interior views of a pass-through port according to an example embodiment of the invention in closed and open configurations, respectively.
Figure 4B:
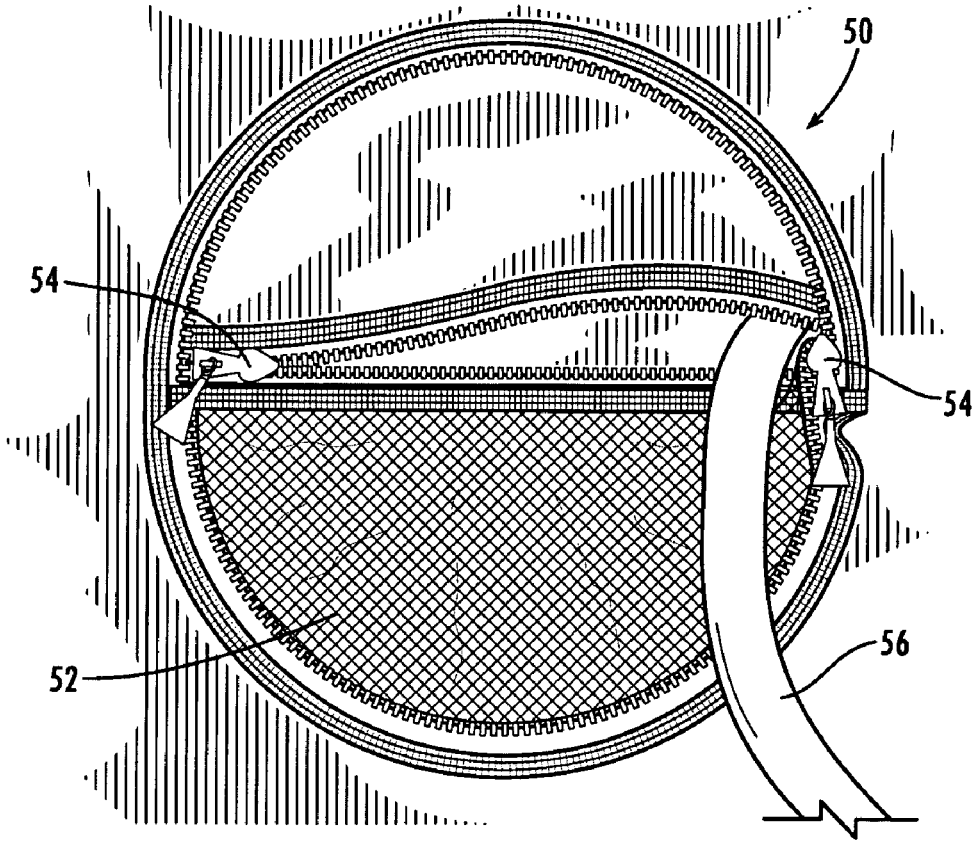
Figure 5A:
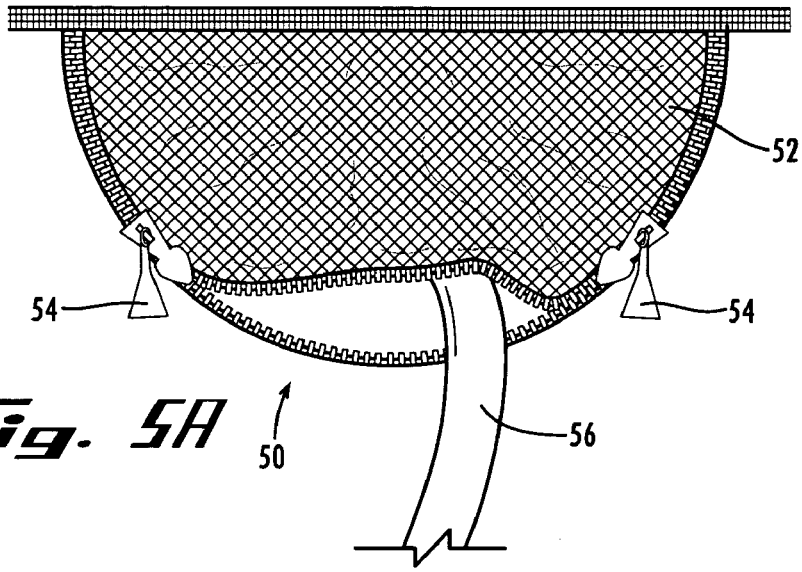
FIGS. 5*a* and 5*b* are interior views of a pass-through port according to another example embodiment of the invention in open and closed configurations, respectively.
Figure 5B:
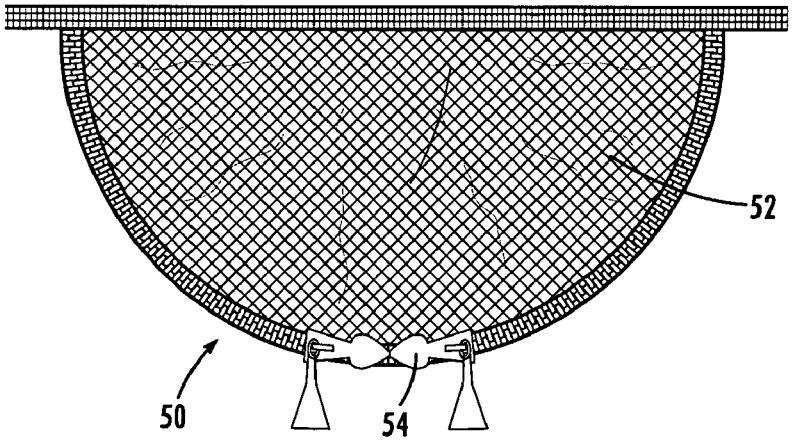

In particular examples, the pass-through port 50 comprises a semi-circular slit through a wall panel, proximal the floor of the tent 10 as seen in FIG. 4*a*. The semi-circular slit of the pass-through port 50 can be in the shape of an inverted U (FIGS. 4*a*, 4*b*), an upright U (FIGS. 5*a*, 5*b*), or otherwise configured. In other embodiments, the port 50 comprises a rectangular opening, a straight or curved slit, or is otherwise configured. A mesh port cover 52 is optionally provided, which can be selectively closed (FIG. 4*a*) and opened (FIG. 4*b*), as by operation of a two-way zipper closure 54. In alternate embodiments, the closure comprises a hook-and-loop fastener system, an adjustable cord drawstring and/or other selectively operable closure means such as a zipper. In example forms, the pass-through port 50 has a maximum dimension of about twelve inches and a minimum dimension of about two inches, for convenience and ease of use. Of course, those skilled in the art will recognize that the size, shape and location of the pass-through port can vary, depending on the tent dimensions and configuration and the intended application.

In use, the closure is selectively opened and closed as needed to permit a user to pass items in and out of the tent through the port, without the need for opening the tent door. In addition, the closure preferably can be opened from the inside or outside of tent to permit a user to extend an electrical cord, a hose or other item through the port, and then tightened snugly around the item extending through the port to seal or minimize any opening or gap that could otherwise provide opportunity for insects to enter the tent's interior, and also to secure the item in place. The pass-through port 50 can also serve as a ventilation port for adjustable air circulation.

Figure 6A:
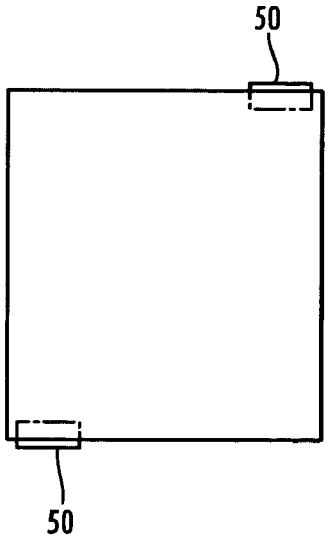
FIGS. 6*a* and 6*b* are plan views of a tent according to two example embodiments of the invention, having diagonally opposite corner pass-through port locations, and having pass-through ports located centrally on opposite sidewalls, respectively.
Figure 6B:
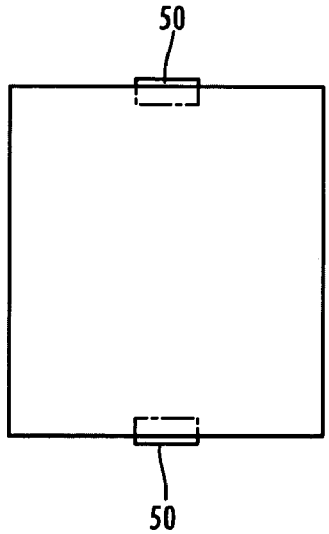

The location(s) of the pass-through port 50 through the fabric panels of the tent can vary, and example locations are shown in FIGS. 6*a* and 6*b*. For example, in the embodiment of FIG. 6*a*, two ports 50 are arranged diagonally opposite one another on the sidewalls proximal the corners of the tent. In the embodiment of FIG. 6*b*, two ports are located directly opposite one another in the middle of the sidewalls of the tent. Of course, it will be recognized that other port locations and configurations are also within the scope of the present invention.

While the invention has been described with reference to preferred and example embodiments, it will be understood by those skilled in the art that a variety of modifications, additions and deletions are within the scope of the invention, as defined by the following claims.

What is claimed is:

1. An outdoor tent for overnight human habitation in inclement weather, comprising:

a floor, at least one wall panel, and a roof cooperatively defining an interior of the tent, the wall panel having a bottom attached to the floor;

one or more door openings formed in the wall panel and one or more doors covering the door openings, the doors movable to an open position to expose the door openings for human ingress and egress to and from the interior of the tent; and at least one pass-through assembly including a pass-through port, a mesh panel, and a closure, wherein the port is formed in a lower portion of the wall panel, is located about two to eighteen inches above the floor, and has a minimum dimension of about two inches and a maximum dimension of about twelve inches, wherein the mesh panel is selectively movable by operating the closure between a closed position fully covering the port, an open position fully exposing the port so that an object can be routed through a portion of the port, and an intermediate position covering all but the portion of the port occupied by the object extending through the port and cooperating with the wall to fit snugly and conformingly around the object extending through the port to secure it in place, and wherein the closure is selectively movable between a closed position retaining the mesh panel in the closed position, an open position permitting the mesh panel to be moved to the open position, and an intermediate position retaining the mesh panel in the intermediate position, wherein the mesh panel and the closure are movable to their respective intermediate positions, with the object extended through the port and with the mesh panel and the wall fitted snuggly and conformingly around the object to prevent ingress of insects into the interior of the tent, allow airflow into the tent interior, and secure the object in place, without opening any of the doors, without extending the object through any of the door openings, and without hindering the human ingress and egress through the door openings.

2. The tent of claim 1, wherein the pass-through assembly further comprises port cover flap overlying mesh panel in the closed position.

3. The tent of claim 1, wherein the pass-through port comprises a semi-circular opening.

4. The tent of claim 1, further comprising one or more windows formed in the wall panel and one or more window cover flaps covering the windows, the window cover flaps movable to an open position to expose the windows for viewing into and out of the interior of the tent and for ventilation, wherein the mesh panel and the closure are movable to the intermediate position, with the object routed through the port and with the mesh panel and the wall fitted snuggly and conformingly around the object to prevent ingress of insects into the interior of the tent, to allow airflow into the tent, and to secure the object in place, without opening any of the window cover flaps, without extending the object through any of the windows, and without interfering with the visibility or ventilation through the windows.

5. The tent of claim 4, wherein the pass-through port is located in the wall panel above the floor and below or subjacent the windows.

6. The tent of claim 1, wherein the closure is selected from the group consisting of a zipper, a hook-and-loop fastener system, and a drawstring.

7. An outdoor tent for overnight human habitation in inclement weather, comprising:

one or more wall panels, a floor, and a roof cooperatively defining an interior of the tent;

one or more door openings in the wall panels and one or more doors covering the door openings, the doors movable to an open position to expose the door openings for human ingress and egress to and from the interior of the tent;

one or more windows formed in the wall panels and one or more window cover flaps covering the windows, the window cover flaps movable to an open position to expose the windows for viewing into and out of the interior of the tent and for ventilation; and a pass-through assembly consisting of a pass-through port and a port cover flap, wherein the pass-through port is formed in a lower portion of one of the wall panels above the floor and below or subjacent the windows, is located about two to eighteen inches above the floor, and has a minimum dimension of about two inches and a maximum dimension of about twelve inches, and wherein the port cover flap is selectively movable by operating a closure between a closed position fully covering the port, an open position fully exposing the port so that an object can be routed through a portion of the port, and an intermediate position covering all but the portion of the port occupied by the object extending through the port and cooperating with the wall to fit snugly and conformingly around the object extending through the port to secure it in place, wherein the port cover flap is movable to the intermediate position, with the object extended through the port and with the port cover flap and the wall fitted snuggly and conformingly around the object to prevent ingress of insects and rain into the interior of the tent and to secure the object in place, without opening any of the doors or any of the window cover flaps, without extending the object through any of the door openings or any of the windows, without hindering the human ingress and egress through the door openings, and without interfering with the visibility or ventilation through the windows.

8. The tent of claim 7, wherein the closure is selected from the group consisting of a zipper, a hook-and-loop fastener system, and a drawstring.

9. An outdoor tent for overnight adult human habitation in inclement weather and for enclosing an electric-operated device that uses an outdoor power cord, the tent comprising:

one or more wall panels, a floor, and a roof cooperatively defining an interior of the tent;

one or more door openings formed in the wall panels and one or more doors covering the door openings, the doors movable to an open position to expose the door openings for adult human ingress and egress to and from the interior of the tent;

one or more windows formed in the wall panels and one or more window cover flaps covering the windows, the window cover flaps movable to an open position to expose the windows for viewing into and out of the interior of the tent and for ventilation; and one or more pass-through assemblies each consisting of a pass-through port, a mesh panel, a closure, and a port cover flap, wherein the port is formed in a lower portion of one of the wall panels, is located about two to eighteen inches above the floor, is located below or subjacent the windows, has a minimum dimension of about two inches, and has a maximum dimension of about twelve inches, wherein the mesh panel is selectively movable by operating the closure between a closed position fully covering the port, an open position fully exposing the port so that the power cord can be routed through a portion of the port, and an intermediate position covering all but the portion of the port occupied by the power cord extending through the port and cooperating with the wall to fit snugly and conformingly around the power cord extending through the port to secure it in place through the wall panel, wherein the closure is selectively movable between a closed position retaining the mesh panel in the closed position, an open position permitting the mesh panel to be moved to the open position, and an intermediate position retaining the mesh panel in the intermediate position, and wherein the port cover flap is selectively movable between a closed position fully covering the port, an open position fully exposing the port so that the power cord can be extended through the port, and an intermediate position exposing at least the portion of the port occupied by the power cord extending through the port, wherein the mesh panel and the closure are movable to their respective intermediate positions, with the power cord extending through the port and with the mesh panel and the tent wall fitted snuggly and conformingly around the power cord to prevent ingress of insects into the interior of the tent, allow airflow into the tent interior, and secure the power cord in place, with the cover flap in the open position to allow airflow into the tent interior or in the intermediate position to prevent the ingress of rain into the tent interior, all without opening any of the doors or any of the window cover flaps, without extending the power cord through any of the door openings or any of the windows, without hindering the adult human ingress and egress through the door openings, and without interfering with the visibility or ventilation through the windows.

10. The tent of claim 9, comprising two of the pass-through port assemblies.

11. The tent of claim 10, wherein the two pass-through port assemblies are located in diagonally opposite corners of the tent.

12. The tent of claim 10, wherein the two pass-through port assemblies are located directly across from one another.

13. The tent of claim 9, wherein the port cover flap has a top edge and two side edges that are attached to one of the walls, and wherein the port cover flap is pleated with sufficient fabric to be moved to the open position not blocking the port and extending away from the wall with the attached top and side edges preventing the ingress of rain into the interior of the tent.

14. The tent of claim 13, further comprising means for selectively holding the port cover flap in the open position or the closed position.

15. A method of routing a power cord between the interior of the outdoor tent of claim 9 and outside of the tent, the method consisting of:

assembling the tent outdoors;

opening the port cover flap and the mesh panel by operating the closure to access the pass-through port formed in the lower portion of the wall of the tent above the floor of the tent and below or subjacent the windows;

extending the power cord through the pass-through port without opening any of the doors, any of the windows, or any other opening of the tent;

moving the mesh panel and the closure to their respective intermediate positions with the mesh panel in a snug and conforming fit with the power cord and with the closure retaining the mesh panel in place to keep insects from passing through the pass-through port to the tent interior; and moving the cover flap to its intermediate position to prevent rain from passing through the pass-through port into the tent or leaving the cover flap in its open position to allow airflow through the mesh panel and into the tent.

16. The tent of claim 9, wherein the closure is selected from the group consisting of a zipper, a hook-and-loop fastener system, and a drawstring.

17. The tent of claim 9, wherein the closure comprises a first closure element and a second closure element, with the first closure element peripherally surrounding the port and the second closure element traversing the port.

18. The tent of claim 9, wherein the closure is a two-headed zipper that can be moved to the intermediate position with the power cord fitted snuggly between the two zipper heads.

19. The tent of claim 9, wherein the closure is a double-sided zipper that can be opened and closed from the interior of the tent and from outside of the tent.

* * * * *